US006582269B2

(12) United States Patent
Sakai et al.

(10) Patent No.: US 6,582,269 B2
(45) Date of Patent: Jun. 24, 2003

(54) LAMP APPARATUS AND LAMP APPARATUS MANUFACTURING METHOD

(75) Inventors: Kenji Sakai, Kanagawa-ken (JP); Sumio Hashimoto, Kanagawa-ken (JP); Hisao Hosoya, Kanagawa-ken (JP); Masaaki Komiya, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 20 days.

(21) Appl. No.: 09/905,975

(22) Filed: Jul. 17, 2001

(65) Prior Publication Data

US 2001/0038261 A1 Nov. 8, 2001

Related U.S. Application Data

(62) Division of application No. 09/493,071, filed on Jan. 28, 2000.

(30) Foreign Application Priority Data

Jan. 28, 1999 (JP) ..... 11-020838
Mar. 9, 1999 (JP) ..... 11-061801

(51) Int. Cl.[7] ..... H01J 9/00; H01J 9/20

(52) U.S. Cl. ..... 445/26; 439/615; 439/739; 313/318.01; 445/27; 445/22

(58) Field of Search ..... 228/173.2, 173.3, 228/173.5; 445/26, 27, 22; 439/611, 615, 734

(56) References Cited

U.S. PATENT DOCUMENTS

| | | | | |
|---|---|---|---|---|
| 2,336,556 A | * | 12/1943 | Malloy | 439/734 |
| 2,732,532 A | * | 1/1956 | Leighton | 439/615 |
| 3,573,534 A | * | 4/1971 | Leighton | 313/318.01 |
| 3,897,124 A | * | 7/1975 | Pagnotta et al. | 439/734 |
| 5,039,905 A | | 8/1991 | Essers et al. | 313/318 |
| 6,323,588 B1 | * | 11/2001 | Lilljedahl et al. | 313/318.1 |

FOREIGN PATENT DOCUMENTS

| | | |
|---|---|---|
| JP | 49-82574 | 7/1974 |
| JP | 10-275602 | 10/1998 |

* cited by examiner

*Primary Examiner*—Kenneth J. Ramsey
*Assistant Examiner*—Mariceli Santiago
(74) *Attorney, Agent, or Firm*—Pillsbury Winthrop LLP

(57) ABSTRACT

A lamp apparatus comprises a lamp body, a base mounted to the lamp body, the base including a top end of base connected with a first conductor electrically and a threaded portion connected with a second conductor electrically, the top end of base and the first conductor welded through the process of mutual fusion, and a welded portion formed in a convex shape with the mixture of materials of the top end of base and the first conductor.

2 Claims, 5 Drawing Sheets

LAMP APPARATUS AND LAMP APPARATUS MANUFACTURING METHOD

This is a Divisional of National application Ser. No. 09/493,071 filed Jan. 28, 2000.

BACKGROUND OF THE INVENTION

1. Field of the Invention

The present invention relates to a lamp apparatus equipped with a base and its manufacturing method.

2. Description of the Related Art

Of bulb type lamp apparatus, a lamp apparatus with a fluorescent lamp mounted to a holder together with a ballast circuit base plate and a base for feeding electric power mounted to the holder is so far known. This base of the fluorescent lamp has a top end of base at one side and a cylindrical threaded portion with the threaded surface at the other side. These base portions are electrically insulated with an insulating portion.

The base is connected with a pair of conductors that are electrically connected to the ballast circuit base plate for feeding electricity. These conductors are connected to the top end of base and the threaded portion, respectively. The conductor is connected to the top end of base using such a technology as soldering or arc welding.

Normally, the top end of base has a flat portion with a through hole formed at nearly its center. The conductor is inserted into the through hole and connected to the base at this flat portion by the soldering or arc welding.

However, there were such problems in the connecting method of a conductor with the top end of base as described above.

Because solder is widely recognized to be a harmful material nowadays, it is desirable to restrain use of it as could as possible.

On the other hand, when connecting a conductor to the top end of base by the arc welding, if they were welded by fusing much amount of them in order to solidly connect, holes might be produced as the top end of base was largely fused. When holes were produced partially on the welded portion, the connected strength of conductor drops largely.

Then, in order to obtain a sufficient welding strength without fusing much amount of the top end of base, a method is now under the examination to pull out the top end of a conductor to the outside of the base and fuse the whole pulled out portion of this conductor. However, according to this method, the conductor material that became solid after welded tends to spread to a partial range. Such partially spread fused material also lowers the connecting strength between the top end of base and the conductor.

Further, when such welded portion is protruding from the top end of base excessively, the welded portion is pushed against the lamp socket terminal for feeding power to a lamp apparatus and as a result, the welded portion may be damaged. If the welded portion is damaged, as a matter of course, the contact with the lamp socket terminal tends to become improper.

Further, when welding a conductor, the top end of base is heated. At this time, the nearly entire top end of base becomes a high temperature. As a result, this heat is transmitted to the insulating portion formed by a glass that is insulating the top end of the base and the threaded portion and may crack them and the top end of base may be peeled off from the insulating portion.

SUMMARY OF THE INVENTION

An object of the present invention is to provide a lamp apparatus capable of clearing the above-mentioned problems and a lamp apparatus manufacturing method.

According to the present invention, there is provided a lamp apparatus comprising a lamp body from which first and second conductors are led out; a base mounted to the lamp body, the base including a top end of base with the first conductor electrically connected and a threaded portion with the second conductor electrically connected; and a welded portion that is formed in a convex shape by mixing materials of the top end of base and the first conductor that are welded after they are mutually fused.

According to the present invention, the top end of base and the first conductor are welded through the process wherein they are fused and the welded portion thus formed is in the convex shape and therefore, when the volume of the welded portion is increased by making this convex shaped portion large, the top end of base and the first conductor are solidly connected mechanically.

Further, according to the present invention, there is provided a lamp apparatus comprising a lamp body from which first and second conductors are led out; a base mounted to the lamp body, the base including a top end of base to which a first conductor electrically connected, of which one surface is formed in a flat shape and a dimple formed at near the center of the flat portion; a threaded portion with a second conductor electrically connected; and an insulating member provided between the top end of base and the threaded portion for electrically insulating them; and a welded portion that is formed in a convex shape in the dimple by mixing materials of the top end base and the first conductor that are welded after they are mutually fused.

According to the lamp apparatus of the present invention, as the welded portion is formed in the concave portion, even when the volume of the welded portion is increased, it is possible to suppress the welded portion from excessively protruding from the top end of base. Further, when welding the conductors, it is also possible to form the insulating portion that is insulating the top end of base and the threaded base at a position away from the welded portion. Accordingly, heat generated when welding is hardly transmitted to the insulating portion and it is possible to prevent cracks from producing on the insulating portion and the top end of base from coming off the insulating portion.

Further, according to the present invention, there is provided a lamp apparatus manufacturing method comprising the steps of electrically connecting a first conductor to a top end of base at one side of a base and a second conductor to a threaded portion at the other side, wherein the top end of base has a flat portion and a cylinder portion that has a through hole penetrating the flat portion at nearly the center of the flat portion and a cylinder portion is formed protruding from the flat portion; mounting the base to a lamp body; and welding the cylinder portion and the first conductor by mutually fusing in the state with the top end of the first conductor inserted into the through hole.

According to the lamp apparatus manufacturing method of the present invention, when the inner diameter of the through hole is made larger than the outer diameter of the conductor, it becomes extremely easy to insert the conductor into the through hole. Even in this case, the cylinder portion and the conductor can be certainly connected electrically when the cylinder portion is crushed. Accordingly, when welding the cylinder portion and the conductor, both of them can be fused.

DETAILED DESCRIPTION OF THE PREFERRED EMBODIMENTS

Figure 1:
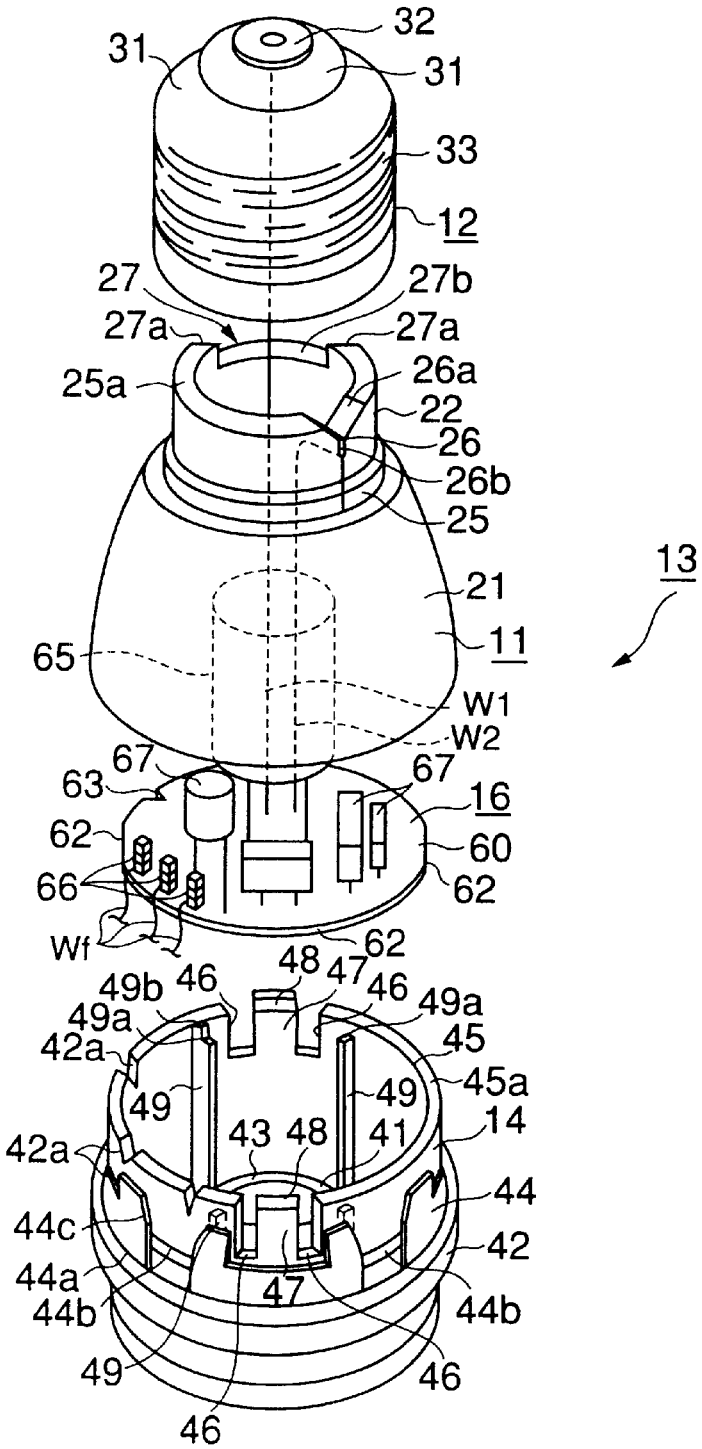
FIG. 1 is a perspective partially exploded view showing an embodiment of a lamp apparatus of the present invention.

In the present invention, unless other wise specified, terms used here are defined as shown below.

A lamp body means a lamp body equipped with such a luminous body as an incandescent lamp, discharge lamp, LED, EL element, cathode-ray tube (CRT) and the like and in particular, in case of lamps such as a discharge lamp that does not emit light even when connected directly to a commercial power source, it does means a lamp body in a structure including a ballast circuit.

In the case of a discharge lamp, discharging medium is filled and in the case of fluorescent lamp, mercury, argon gas and the like are filled at a specified pressure but not restricted thereto. In other words, this discharge lamp can be such high-pressure discharge lamps as HID lamp, etc. or rare gas discharge lamp like xenon lamp and not specifically restricted.

A pair of electrodes are sealed in a bulb of a discharge lamp. The pair of electrodes can be sealed at both ends in a bulb or adjacent at one end or on the outer surface of a bulb. Further, they can be disposed at any other position.

Electrode material and shape are not specifically restricted and can be any material or shape if capable of generating discharge in a bulb of a discharge lamp when voltage in required condition is applied between a pair of electrodes.

The first and second conductors are connected to a pair of outer copper-weld wires when a lamp body is an incandescent lamp, and to feeding terminals of a ballast circuit when it is a discharge lamp, etc.; however, not restricted to this and in short, they are electrically connected so that a luminous body of a lamp body is able to emit light.

A shape of a base is not restricted if the base is provided with a top end of base and a threaded portion. Generally, a base denotes E type or Swan type that is standardized in JIS. Therefore, the shape of the top end of base and the threaded portion are almost specified. However, so far as the present invention is concerned, the top end of base can be in any shape if it contacts a contact piece at the interior in a lamp socket and the threaded portion can be any shape if it contacts a contact piece on the inner surface of a lamp socket when screwed in.

In the present invention, it is required that the top end of base and a conductor are welded after they are fused. However, fused amounts of them are not necessarily equal to each other and if there is no trace of the original form, it is regarded that they have been fused. That is, when there are mixed portions of the top end of base and the conductor, even slight, if attributable to improvement of welded strength of the top end of base and the conductor, it is considered that they have been welded after the fusing process.

Further, it is not necessary for the welded portion that materials of the top end of base and the conductor are mixed in the entirety. That is, when there is a fused and mixed portion of the top end of base with the conductor even when slight if attributable to improvement of their welded strength, that portion is regarded to be a welded portion of mixture of the top end of base and the conductor.

The welded portion can be formed with the same material as the top end of base and the conductor or both materials can be different. In short, materials of the top end of base and the conductor that are capable of being fused and forming a welded portion are acceptable. Further, as a material of the top end of base, brass is generally used in many cases but copper may be used instead of brass. When the top end of base is formed with copper, zinc gas that is produced when welding brass in the arc welding is not generated. Further, the electric contact with a lamp socket is not impeded by zinc gas adhered to the surface of the welded portion after the welding and the beautiful appearance is also not impeded. As copper is fused easily and when it is required to dissolve much amount of copper, the entirety is easily fused sufficiently.

Further, the entirety of welded portion does not need to be formed in a convex shape. On the contrary, a part of the convex portion of the top end of base can be a welded portion.

Hereinafter, a lamp apparatus of the present invention will be explained referring to drawings of an embodiment of the present invention.

Figure 2:
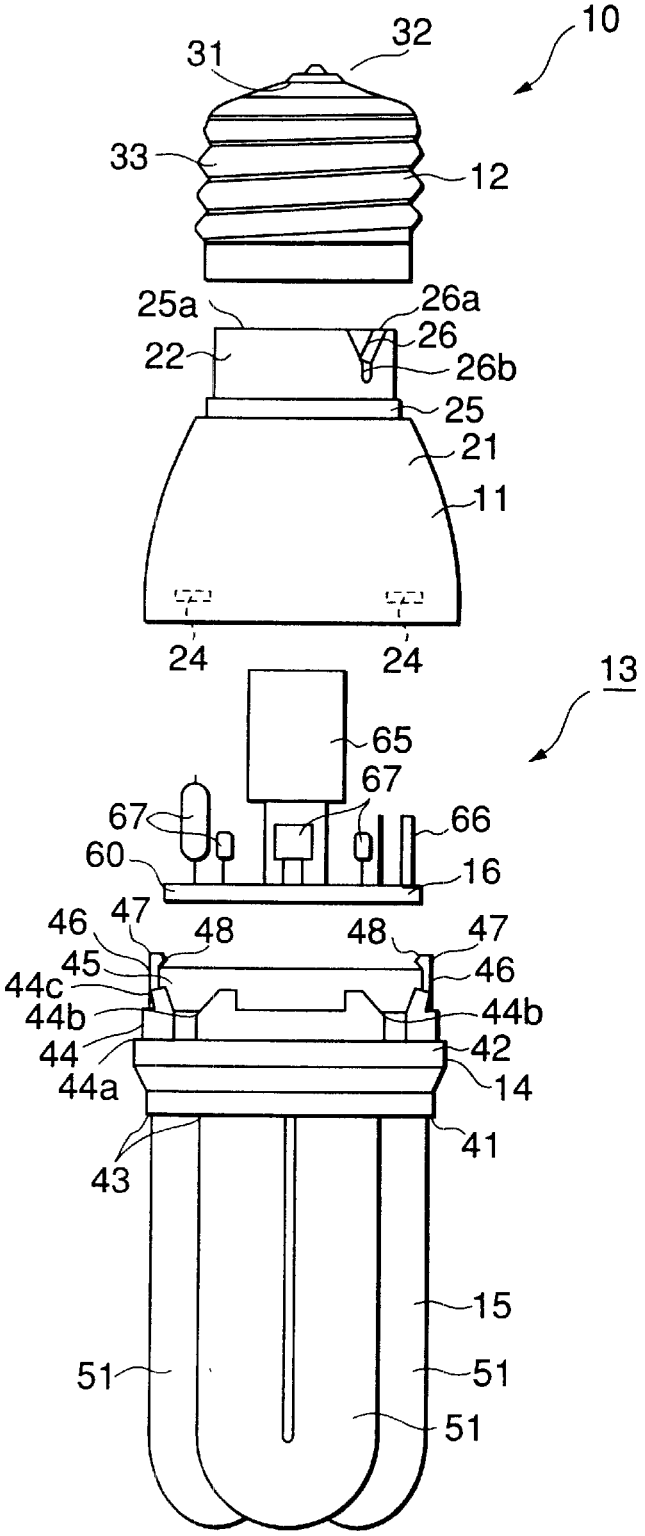
FIG. 2 is a side view showing the exploded lamp apparatus of the present invention.
Figure 3A:
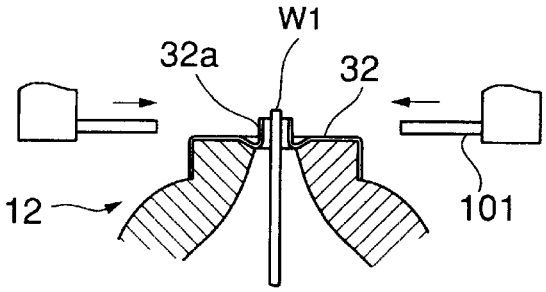
FIG. 3A through FIG. 3D show partial sectional views showing respective processes for welding a first conductor to a base.
Figure 3B:
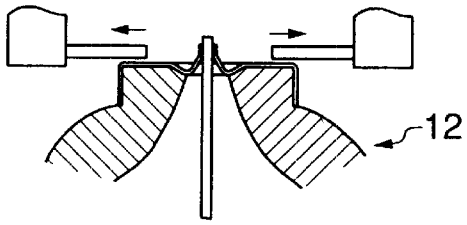
Figure 3C:
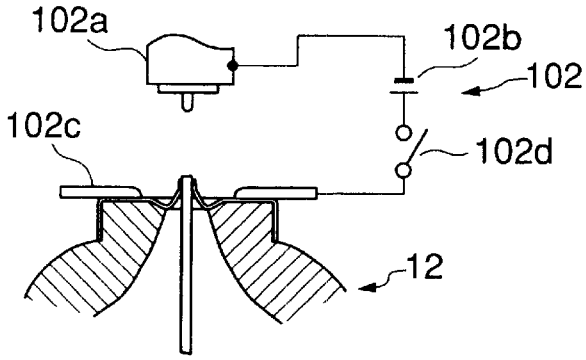
Figure 3D:
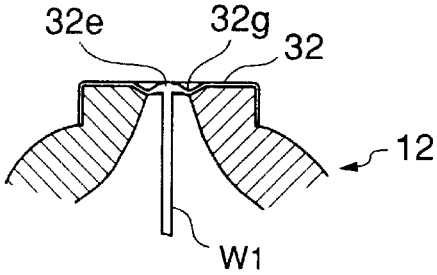
Figure 4:
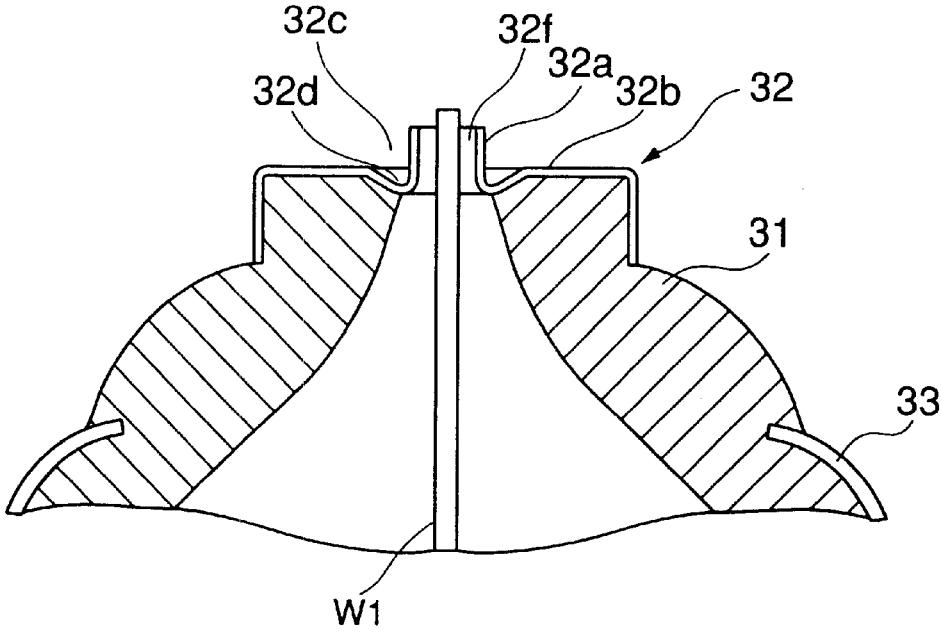
FIG. 4 is a side sectional view showing a part of the base in a process for welding the first conductor.

FIG. 1 is an exploded partially perspective view showing a lamp apparatus of the present invention, FIG. 2 is a side view showing an exploded lamp apparatus, FIG. 3 is a partially sectional view showing the welding process of a first conductor, and FIG. 4 is a top view showing a base in the welding process of the first conductor. The lamp apparatus in this embodiment is a bulb type fluorescent lamp.

In these diagrams, a reference numeral 10 denotes a lamp apparatus, which comprises a lamp body 13 and a base 12. The lamp body 13 comprises a cover 11, a holder 14 which folds a ballast circuit 16, a fluorescent lamp 15 and the like. Hereinafter, the lamp apparatus will be explained with the base 12 side positioned at the upper side.

The cover 11 is also called a base and formed almost in a cylindrical shape with heat resisting synthetic resin such as polybutylene-terephthalate (PBT) as shown in FIG. 1 and FIG. 2. On this cover 11, a cover body 21 that is widened downward and a base fitted portion 22 extending almost cylindrically from the top of this cover body 21 are formed. Near the opening at the lower end of the cover body 21, there are engaging portions 24 protruding in the claw shape from several points. Further, at the lower end of the base fitted portion 22, a base fitted portion 25 in a large diameter is vertically formed in a ring shape. On the top, a conductor inserted portion 26, which is a recess for a conductor, and a guiding recess 27 opening to the top surface 25*a* are formed. On the base fitted portion 25, a conductor guided portion 26*a* widely opening to the top surface 25*a* and a conductor passing groove 26*b* extending downward from the lower end portion of this conductor guided portion 26*a*, that is, toward the base fitted portion 25 are formed. Further, the lower end portion, that is, the top portion of the conductor passing groove 26*b* is formed away from the base fitted portion 25 by a specified size. The guiding recess 27 is formed in a shape partially cutting the top end portion of the base fitted portion 22 in a straight line or a radial shape and in this embodiment, a pair of vertical first guide abutting portions 27*a*, which are mutually positioned on the same plane, and a second guide abutting portion 27*b* in parallel with, that is, horizontal to the top surface 25*a* are formed. These guide abutting portions 27*a*, 27*b* are formed on a smooth flat surface.

The base 12 is used to construct an Edison type base such as E26 type and is provided with an insulating portion 31, a conductive to end of base 32 fixed at the upper center of this insulating portion 31, and a conductive threaded portion 33 that is screwed in a socket fixed to the outer surface of the insulating portion 31. Further, a concave housing portion opening downward is formed on the inside of this base 12.

The holder 14 is also called a dividing body and is made of heat resisting synthetic resin such as polybutylene-terephthalate, and a divider 41 formed in a almost disc shape and a cylindrical portion 42 extending to the top side from the outer surrounding portion of the divider are formed in one united body. Mounting holes 43 are formed on the divider 41 at the top of a regular hexagon. Further, out of the mounting holes 43 at 6 points, two pairs of mounting holes 43 adjacent to each other are formed continuously. On the cylindrical portion 42, there are a substance inserted portion 44 that is positioned at almost the center of the height and engaged with the lower end opening of the cover body 21 of the cover 11, plural conductor passing recesses 42*a* and base plate inserted portions 45 formed.

A ring-shaped stepped portion 44*a* is formed at the outer surface with which the lower end portion of the cover body 21 is engaged, and plural engaged portions 44*b* with which the engaging portion 24 of the cover body 21 is engaged and an engaging portion guide portion 44*c* which guides the engaging portion 24 to the engaged portion 44*b* are formed on the substance inserted portion 44.

On a base plate inserted portion 45, grooves for fastening 46 which open to the top end and paired at specified intervals in the peripheral direction are formed. A space between these paired grooves for fastening 46 becomes resiliently deformable arm portions 47. Engaging portions 48 are projecting in the claw state inward from the ends of these arms. Further, ribs 49 are formed at 4 points at the side of the fastening grooves 46 along the axial direction in the inside of the base plate inserted portion 45. The top end of each rib 49 becomes an abutting portion 49*a*. From the abutting portion 49*a* of the rib 49 at one point out of those at 4 points, an engaging portion 49*b* for positioning is protruded upward. Further, while the top end portion of the engaging portion 49*b* for positioning is formed almost flush with the top end portion of the base plate inserted portion 45, the lower surface of the engaging portion 48 is positioned slightly above the top end portion of the base plate inserted portion 45 and the upper surface of the abutting portion 49*a* is positioned at the slightly lower side of the upper end portion of the base plate inserted portion 45.

The fluorescent lamp 15 has 3 U-shaped lamp bulbs 51 of which intermediate portion is smoothly curved, that is, luminous tubes arranged at specified positions and connected with connecting pipes (not shown) and one discharge circuit is formed. Each bulb 51 has a fluorescent film formed on the inner surface and such rare gas as argon, mercury is filled in the inside. At the bulb ends at both ends of the discharge circuit, filaments, that is, electrodes are sealed.

The ballast circuit 16 is provided with a disc shaped base plate 60, that is, a so-called circuit substrate. On the base plate 60, a straight edge 62 is formed by straightly cutting four sides of a disc that is fitted to the inside of the base plate inserted portion 45 and further, a positioning engaged portion 63 is formed by partially cutting the outer surface. On the upper surface and/or other surface of the base plate 60, plural electric parts are mounted and an inverter circuit for the high-frequency light, that is, a high-frequency ballast circuit is formed. Electric parts include an electrolytic capacitor 65 arranged at the central part, a cylindrical lapping pin 66, and other parts such as transistor, chip-shaped rectifier device, resistor and the like 67. On the lower surface of the base plate 60, relatively strong heat resistive and thin parts are mounted. Further, from the base plate 60, the first and second the first and second conductors W1, W2 connected to a high-frequency ballast circuit are led out toward the base 12 side.

When assembling the lamp apparatus 10, insert the base ends of the lamp bulbs 51 of the fluorescent lamp 15 into the mounting holes 43 of the holder 14 from the lower side and fix by filling such a bonding agent as silicon from the upper side.

Then, pass three or four conductors Wf connected to the electrodes of the fluorescent lamp 15 through the inside of the holder 14, lead them to the outer surface side through the conductor passing recess 42*a*, insert the base plate 60 into the base plate inserting portion 45 from the opening on the upper side of the holder 14 and fix them. In other words, by holding both sides of the straight edges 62 at two points of the base plate 60 with chucks comprising the manufacturing apparatus, position the chucks in the grooves for fastening 46, and while holding the base plate 60 with the chucks, press fit the base plate 60 into the base plate inserting portion 45, and move the chucks to the side. The disc shaped outer portion of the base plate 60 is fit to the inner surface of the base plate inserting portion 45 and the lower surface of the base plate contacts the abutting portion 49*a* of the ribs, the upper surface of the straight edge 62 of the base plate 60 engages with the engaging portions 48 and is held so that it does not come off. Further, the upper surface of the base plate 60 is held flush with the upper surface 45*a* of the base plate inserting portion 45 under this state or in the state protruding upward therefrom.

Then, wind one end of the conductor Wf led out to the outer surface round 3 or 4 lapping pins 66 mounted on the surface of the base plate 60 with a winding device comprising the manufacturing apparatus and connect them mechanically and electrically.

Further, after passing the first and second conductors W1 and W2 of which ends are soldered to the base plate 60 through the inside of the cover 11, apply a bonding agent, if necessary, to the holder 14 with the fluorescent lamp 15 and the base plate 60 mounted, press fit the holder 14 through the opening of the cover 11, engage the engaging portion 24 of the cover 11 with the engaging portion 44*b* of the holder 14, and fix the cover 11 and the holder 14.

Connect the other end of the first conductor W1 to the top end 32 of the base 12 electrically and mechanically by welding. Lead out the other end of the second conductor W2 to the outside of the base fitted portion 22 through the conductor inserting portion 26, turn it back and dispose on the base fitted portion 25. In this state, move the housing concave portion of the base 12 to the base fitted portion 22 and put it over there, and from the outer portion of the base fitted portion 25, press it diagonally at several points, that is, in 6 directions or more and 10 directions or less, for instance, from 8 directions. In other words, caulk it at 8 points. Thus, the second conductor W2 is held between the base fitted portion 25 and threaded portion 33 and electrically connected to the threaded portion 33, the base 12 is fixed to the cover 11, and the lamp apparatus 10 is assembled.

Here, on the top end of base 32 with the first conductor W1 welded, a convex state welded portion having a gentle slope is formed. The connecting process of the first conductor W1 and the top end of base will be explained below referring to FIG. 3. FIG. 3A through FIG. 3D are diagrams showing a part of the base connection process of the lamp manufacturing method of the present invention. A part of the section of the base is shown in FIG. 3A through FIG. 3D. FIG. 4 is a side sectional view showing a part of the base in the conductor welding process.

First, referring to FIG. 4, the top end of base will be explained. Reference Numeral 32*a* is a cylinder portion protruding nearly to the central portion of the flat portion of the top end of base 32. The top end of base 32 is formed with copper. Therefore, the cylinder portion 32*a* is formed with copper in one united body with other portions of the top end of base 32, for instance, the flat portion. The cylinder portion 32*a* is in the hollow state and this hollow portion forms a through hole vertically penetrating the flat portion of the top end of base 32. The top end of base 32 has a dimple 32*c* nearly at the center of the flat portion 32*b* and the cylinder portion 32*a* is formed in this dimple. Thus, a surround groove 32*d* is formed almost in the V-shaped section by the surrounding surface of the cylinder portion 32*a* and the inner surface of the dimple 32*c*. The surround groove 32*d* is formed in a ring shape surrounding the cylinder portion 32*a*. The top end of base 32 is attached to a glass made insulating portion 31 for securing electrical insulation with the threaded portion. Further, there exists no insulating portion 31 under the surround groove 32*d* and the cylinder portion 32*a*. Further, when the insulating portion is not provided under the surround groove 32*d*, the welding heat is hardly transmitted and the generation of crack can be suppressed. However, the insulating portion may be provided under the surround groove in such a manner that the generation of crack on the insulating portion becomes not a problem.

FIG. 3A shows the first conductor W1 attached so that it can be connected to the top end of base 32. As shown here, the first conductor W1 and the base 12 are held with individual devices (not shown) in the state where the top end of the first conductor W1 is kept at the same position as that of the top end of the cylinder portion 32*a*.

FIG. 3B shows the state wherein the first conductor W1 is fixed with the cylinder portion 32*a* crushed from the side at the top end of base 32 in the state shown in FIG. 3A. In this diagram, Reference Numeral 101 shows punches disposed at the side of the cylinder portion 32*a* with an equal space (90°) in the peripheral direction. These punches are for crushing the outer surface of the cylinder portion 32*a* to a specified depth by oscillating the punches 101 facing each other with the cylinder portion 32*a* between so that they come close to each other. As four punches 101 are oscillated simultaneously toward the center of the cylinder portion 32*a*, the force is applied simultaneously from 4 directions, the cylinder portion 32*a* is prevented from tilting. The cylinder portion 32*a* can be avoided from tilting using more than 3 punches. When protruding the top end of the first conductor W1 from the cylinder portion 32*a* in this state, the adjustment of its shape becomes easy and it is possible to visually check whether the first conductor W1 is inserted and crushed.

The base end of the cylinder portion 32*a* forms a part of the surround groove 32*d* having a nearly V-shape section as described above. Therefore, when the cylinder portion 32*a* is deformed in the crushing process using the punches 101, a reaction is generated and this reaction tends to affect other portions of the top end of base 32. However, the majority of the reaction can be absorbed in the surround groove 32*d* and other portions of the top end of base 32 will not be deformed.

In this embodiment, the inner diameter of the through hole 32*f* of the cylinder portion 32*a* is about 1.5 mm and the outer diameter of the first conductor W1 is about 0.5 mm. This dimensional difference makes it very easy to insert the first conductor W1 into the through hole 32*f*. Accordingly, in the state of the first conductor W1 inserted into the through hole 32*f*, the cylinder portion 32*a* and the first conductor W1 are not electrically connected; however, both of them are surely connected electrically and mechanically in the process shown in FIG. 3B, and the cylinder portion 32*a* and the first conductor W1 can be fused by the plasma arc welding in the process shown in FIG. 3C, which will be described later. Thus, when a difference between the outer diameter of the first conductor W1 and the inner diameter of the through hole 32*f* is large, in order to fix the first conductor W1 to the cylinder portion 32*a*, it is necessary to largely deform the cylinder portion 32*a*. However, the deformation of those portions other than the cylinder portion 32*a* of the top end of base 32 accompanied with the crushing process can be prevented by the surround groove 32*d* as described above. Further, the material thickness of the top end of base in this embodiment is about 0.3 mm. Therefore, if the top end of base is formed using material in thickness less than this thickness, it may be said that there is a similar deformation preventing action.

Figure 5:
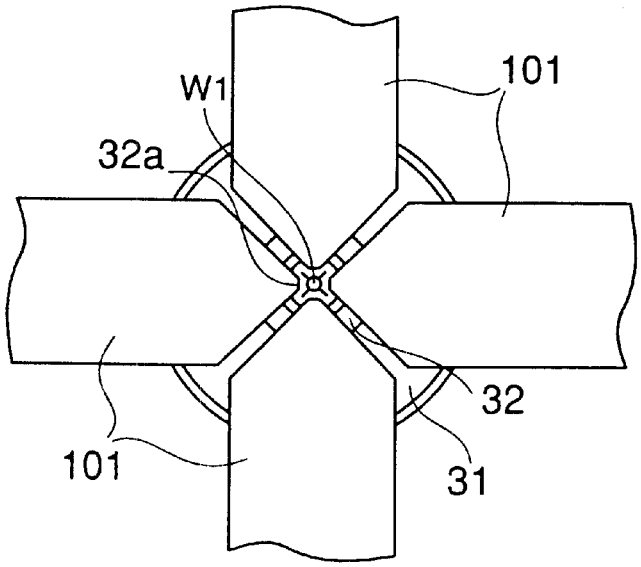
FIG. 5 is a top view showing the base in another process for welding the first conductor.
Figure 6:
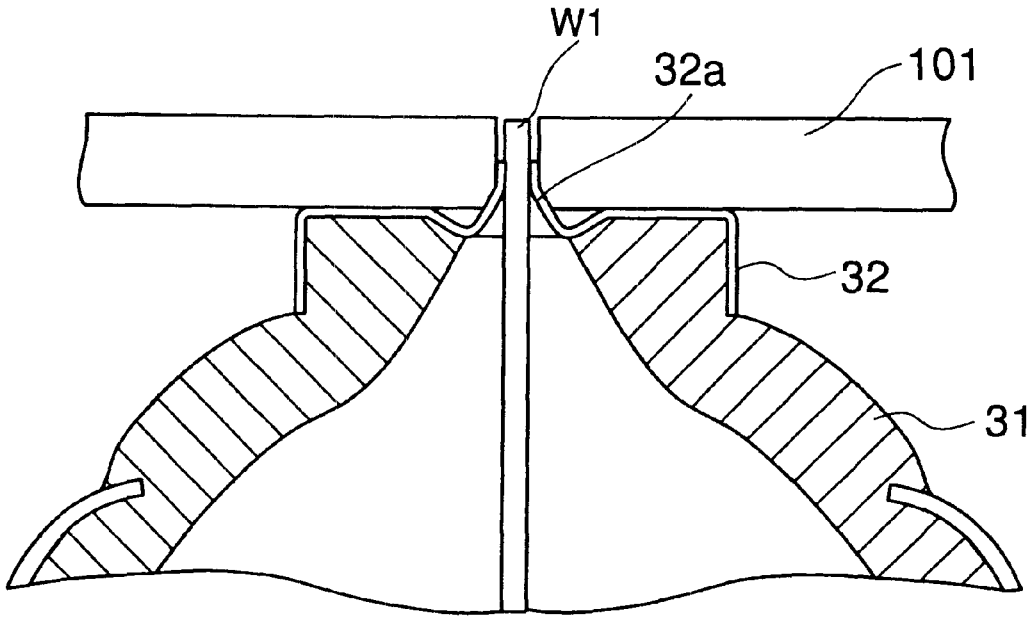
FIG. 6 is a side sectional view showing the base in another process shown in FIG. 5.

Further, the state of the cylinder portion 32*a* crushed by the punches 101 in this crushing process is shown in FIG. 5. FIG. 5 is a top view of the base. As shown here, the section of he cylinder portion 32*a* is formed in a cross shape. Further, FIG. 6 is a side sectional view of the same.

FIG. 3C shows the state of a lamp apparatus of which top end of base is machined to the state shown in FIG. 3B installed on a welding machine. In FIG. 3C, 102 shows a welding machine which is schematically shown here. 102*a* is a plasma torch. 102*b* is an AC power source to supply current to the plasma torch 102*a*. 102*c* is a base side terminal, which contacts the top end of base 32 and supplies power thereto and is connected to the AC power source 102*b*. 102*d* is a switch to turn ON/OFF power to the plasma torch 102*a*. Further, in FIG. 3B, the power source 102*b* is explained as a DC power source but when the threaded portion 33 is made of aluminum, etc., an AC power source can be used.

When the switch is turned OFF in this state, a plasma arc is produced between the plasma torch 102*a* and the cylinder portion 32*a* or the top end of the first conductor W1. The first conductor W1 and the cylinder portion 32*a* are fused and weld by this plasma arc energy. At this time, voltage to be applied to the plasma torch 102*a* and welding time are adjusted so that the first conductor W1 and the cylinder portion 32*a* only are fused and other portions of the top end of base 32 are not fused.

FIG. 3D shows the top end of base after the plasma welding was executed. As shown here, the first conductor W1 and the cylinder portion 32*a* are welded into one united body and the welding portion formed as a result is in the convex shape formed in the curved surface. This welding portion 32*e* is formed in a round shape centering round the through hole of the top end of base. Further, the welding portion 32*e* remains at the central portion of the dimple 32*c* and the top end portion of the welding 32*e* is at a nearly same height as the opening of the dimple 32*c*. As clearly seen in FIG. 3D, the welding portion 32*e* remains at the central portion of the dimple 32*c* and does not reach the portion that is in contact with the insulating portion of the top end of base 32. This is because the ring shaped surround groove 32*g* in the nearly V-shaped section is formed to surround the welding portion by the outer surface of the welding portion 32*e* and the inner surface of the dimple 32*c*, welded glass is hardly formed at the center of the dimple 32*c* exceeding the surround groove 32*g* when the insulating portion 31 is formed from fused glass. Thus, the insulating portion 31 is prevented from coming close to the welding portion 32*e* and being heated unnecessarily and the generation of crack on the insulating portion 31 and peeling-off of the top end of base are prevented. Further, as the top end portion of the welding portion 32*e* is in the same height as the opening of the dimple 32*c*, the mechanical strength of the welding portion 32*e* can be maintained at a proper level. Further, from the viewpoint of the mechanical strength and electrical contact, the protruding height of the welding portion 32*e* at about 1.5 mm or less below from the opening of the dimple 32*c* is preferred.

Next, other actions that are obtained from the structures in this embodiment will be explained. According to this embodiment, with respect to the shape and the manufacturing method of a bulb type fluorescent lamp, the first conductor W1 of the first and second conductors W1 and W2 connected to a base plate 60 of the ballast circuit 16 is passed through the inside of the cylindrical base fitted portion 22 and connected to the top end of base 32 of the base 12. The second conductor W2 is led to the outside of the base fitted portion 22 through the conductor inserted portion 26. This conductor W2 is turned back and disposed on the base fitted portion 25 and thus, it can be mechanically fixed to the base 12 and electrically connected to the threaded portion 33. The base fitted portion 25 that is engaged with the inner surface of the base 12 is provided to the base fitted portion 22, and the conductor inserted portion 26 is formed at a position separated from the base fitted portion 25. That is, the length of recess of the conductor inserted portion 26 is made to a length not reaching the end of opening of the shell portion of the base 12. So, when compared with the structure wherein the recess of the conductor inserted portion is provided to the position of the end of opening of the shell portion of the base 12, this simple structure is capable of easily improving the waterproof property and reducing manufacturing cost.

On the base fitted portion 22, a pair of first guide abutting portions 27*a* are formed at the position on the same vertical plane. Therefore, by abutting a rail that is a guide member to these guide abutting portions 27*a*, the direction of the cover 11 can be easily and accurately grasped in the conveying process to convey the base in the horizontal direction. Thus, a work to pass the second conductor W2 through the conductor inserted portion 26 becomes easy, the automation of the assembling work becomes easy and manufacturing cost can be reduced. Further, because second guide abutting portions 27*b* which are orthogonal to the first guide abutting portions 27*a* and of which bottom surfaces become horizontal are provided, the position can be controlled simultaneously for the different two lateral and vertical directions with the first and second abutting portions 27*a* and 27*b* provided on the top end portion of the base fitted portion 22. Further, when the second guide abutting portions 27*b* are made to the horizontal plane surfaces, the cover 11 can be made so as to hardly tilt even when the second guide abutting portions 27*b* strike against the guide for the first guide abutting portion 27*a*.

Further, when the base 12 is moved in one direction and fixed to the base fitted portion 22 by caulking it, it is only required to insert the base 12 in the floated state into the cover 11 in the preceding caulking process and when compared with a structure including a work to thread the base 12 into the cover 11, the automated assembling work becomes more easy and a manufacturing cost can be reduced. Further, when the base is caulked from 6 directions or more, the strength can be secured and the tentative fixing (auxiliary fixing) by screw-in becomes unnecessary. On the other hand, when the base is caulked from 10 directions or less, a manufacturing equipment can be simplified and a manufacturing cost can be reduced. Further, when the punching points for caulking are faced each other and are spaced equally, the base 12 becomes hard to tilt and can be fixed at an accurate position. Preferably, for instance, when the base is caulked at 8 points, the tilt preventing effect can be further improved. That is, when caulking the base at 8 points, using a machine capable of punching 8 points simultaneously at a space of 45°. The base can be caulked firmly using a relatively simple equipment. Further, because the second conductor W2 is disposed between the base fitted portion 25 of the base fitted portion 22 of the cover 11 and the base 12, the base 12 is closely fitted to the second conductor W2 by the caulking and deformed to a convex shape at the position where the second conductor W2 is disposed. The electrical and mechanical connection of the second conductor W2 and the base 12 can be visually confirmed easily and certainly. When the base is caulked at 6 points or more, the punched positions and the position of the first conductor W1 are closed and the position of the second conductor W2 can be deformed to the convex shape certainly.

The waterproof function can be further promoted when such a seal member as O-ring is provided between the base fitted portion 22 of the cover 11 and the end of the threaded portion of the base 12, that is, the end of the shell portion in addition to the structure of the above-mentioned embodiment.

In the above-mentioned embodiment, the structure where the fluorescent lamp 15 is exposed is explained. It is also possible to provide various shaped globes as a light control body. Further, the structure and the manufacturing method of conductors to the base shown above are applicable widely to other lamp apparatus such as HID lamp having the same kind of base shape.

According to the lamp apparatus of the present invention, the top end of base and the conductors are welded in the process for mutually fusing and the welded portion comprising mixed materials of the top end of base and the conductors is formed in the convex shape and therefore, when the volume of the welded portion is made large by increasing this convex shaped portion, the top end of base and the conductors are solidly and mechanically connected.

Accordingly, by restricting the extension of the fused portion of the top end of base to the flat portion, the formation of holes resulting from fusion of the top end of base can be avoided and further, even when amount of the conductor that is fused by an equal amount of the fused top end of base is reduced, the sufficient welding strength can be obtained. Therefore, amount of the conductor that is fused can be reduced, the material of conductor that was solidified after welded becomes hard to spread to a one-sided range against the through hole of the top end of base, and the mechanical strength of the welding can be secured.

This is because the ring shaped surround groove 32*g* in the nearly V-shaped section is formed to surround the welding portion by the outer surface of the welding portion 32*e* and the inner surface of the dimple 32*c*, welded glass is hardly formed at the center of the dimple 32*c* exceeding the surround groove 32*g* when the insulating portion 31 is formed from fused glass. Thus, the insulating portion 31 is prevented from coming close to the welding portion 32*e* and being heated unnecessarily and the generation of crack on the insulating portion 31 and peeling-off of the top end of base are prevented. Further, as the top end portion of the welding portion 32*e* is in the same height as the opening of the dimple 32*c*, the mechanical strength of the welding portion 32*e* can be maintained at a proper level. Further, from the viewpoint of the mechanical strength and electrical contact, the protruding height of the welding portion 32*e* at about 1.5 mm or less below from the opening of the dimple 32*c* is preferred.

Further, materials that are fused when fusing the welded portion will not overflow from the dimple.

According to the lamp apparatus of the present invention, even when the lamp socket terminal mechanically contacts the top end portion of the welded portion only, it is possible to make the surface contact of the lamp socket terminal and the welded portion and the poor contact hardly occurs.

According to the lamp apparatus of the present invention, the conductors can be welded at positions separated from the insulating portion which is insulating the top end of base and the threaded portion. Accordingly, heat generated at the time of welding is hardly transmitted to the insulating portion and generation of cracks on the insulating portion and peeling of the top end of base from the insulating portion can be prevented.

According to the lamp apparatus manufacturing method of the present invention, when the inner diameter of the through hole is made larger than the outer diameter of the conductor, it becomes very easy to insert the conductor into the through hole. In this case, however, the cylinder portion and conductor can be firmly connected electrically by crushing the cylinder portion. Therefore, when welding the cylinder portion and the conductor, they can be fused jointly.

Further, because of the conductor fixed to the cylinder portion in the crushing process, the welded portion of joined cylinder portion and conductor is shaped by this fixation, the convex-shaped welded portion obtained by welding the cylinder portion and conductor can be shaped to the specified dimensions, and the welded portion can be made to a shape having a highly mechanical strength. Further, in the state where the conductors are fixed to the cylinder portion in the crushing process, it becomes easy to estimate whether a required shape that has a highly mechanical strength by the welding that is performed subsequently can be obtained by looking the shape of this crushed welded portion and easy to make the quality control.

According to the present invention, because the top end of base has a ring-shaped surround groove that is almost in the V-shaped section surrounding the cylinder portion formed by the peripheral surface of the cylinder portion and the inner surface of the dimple, the deforming reaction produced by the crush of the cylinder portion in the crushing process of the cylinder portion can be absorbed and the deformation of other portions than the cylinder portion and the surround groove of the top end of base, for instance, the flat portion can be prevented.

In the above-mentioned embodiment, the lamp body comprising the base, the holder retaining the ballast circuit and the fluorescent lamp is explained. However, the lamp body can be only a lamp bulb with a built-in filament. An incandescent lamp comprises this lamp body with a base attached. In the case of an incandescent lamps, the electrical connection may be made by welding the second conductor to the threaded portion.

What is claimed is:

1. A lamp apparatus manufacturing method comprising:

electrically connecting a first conductor to a top end of a base at one side of the base and a second conductor to a threaded portion at the other side of the base, wherein the top end of base has a flat portion and a cylinder portion that has a through hole penetrating the flat portion at nearly the center of the flat portion and a cylinder portion is formed protruding from the flat portion;

mounting the base to a lamp body; and welding the cylinder portion and the first conductor by mutually fusing in the state with the top end of the first conductor inserted into the through hole, wherein the top end of base is connected to the first conductor by inserting the first conductor into the cylinder portion, fixing the conductor by crushing the cylinder portion from the side and welding them.

2. A lamp apparatus manufacturing method according to claim 1, wherein a dimple is formed at nearly the center of the flat portion of the top end of base, the cylinder portion is formed in the dimple and a ring-shaped surround groove in a nearly V shape section surrounding the cylinder portion is formed with the peripheral surface of the cylinder portion and the inner surface of the dimple.

* * * * *